United States Patent [19]

Pessina et al.

[11] 4,348,020

[45] Sep. 7, 1982

[54] BELT CONVEYOR FOR SIGNATURES

[76] Inventors: Giorgio Pessina; Aldo Perobelli, both of Via Arborina 2, Paderno Dugnano, Italy

[21] Appl. No.: 146,203

[22] Filed: May 5, 1980

[30] Foreign Application Priority Data

May 18, 1979 [IT] Italy ..... 22807 A/79

[51] Int. Cl.[3] ..... B65H 3/04

[52] U.S. Cl. ..... 271/35; 271/119; 271/151

[58] Field of Search ..... 271/34, 35, 150, 151, 271/10, 12, 119

[56] References Cited

U.S. PATENT DOCUMENTS

| | | | |
|---|---|---|---|
| 1,792,878 | 2/1931 | Wagner | 271/35 |
| 2,097,013 | 10/1937 | Bartholdt | 271/119 UX |
| 3,976,291 | 8/1976 | Bernardi | 271/12 X |
| 4,022,332 | 5/1977 | Freakes | 271/150 X |
| 4,240,539 | 12/1980 | Klapp | 271/151 X |

*Primary Examiner*—Richard A. Schacher

*Attorney, Agent, or Firm*—Kirschstein, Kirschstein, Ottinger & Cobrin

[57] ABSTRACT

An improved conveyor for signatures, loose sheets, gathered sheets, and the like, with a device for picking them up. The improved conveyor achieves fast signature transport capabilities in overlapped relationship. A mechanism is also provided for entraining the signatures which are operative on each signature prior to a preceding signature moving fully away from the following one. Advantageously, the entrainment members have an outer surface with a high friction coefficient. The initial section of the elevator conveyor belts follows a path which deviates from the oblique plane of lay thereof, preferably a substantially vertical path.

7 Claims, 9 Drawing Figures

BELT CONVEYOR FOR SIGNATURES

BACKGROUND OF THE INVENTION

This invention relates to an improved belt conveyor for signatures, loose sheets, gathered or pamphletized sheets, and the like, having a device for picking them up. Such conveyors are utilized in particular in bookbindery.

Conveyors of this same general type are known per se. They usually comprise a supporting frame and a substantially horizontal feeder belt run, as well as a substantially sloping elevator belt run forming an obtuse angle with the run of the conveyor belts feeding the signatures or the like. Such feeder belts are operated at a substantially lower speed than said elevator belts.

The practical problem is encountered with known conveyors that, owing to the low speed of the feeder belts, a stack of signatures, loose sheets, gathered sheets or the like (hereinafter referred to as "signatures", for simplicity) is subjected to a forward pushing force which is only applied to that side of the signatures which contacts the feeder belts, so that in the proximity of the transition or transfer area from the horizontal feeder belts to the elevator belts, a frictional engagement action is exerted on the bottom portion of the signatures tending to open them fan-like at the top and cause them to slope or lean towards the feeder belts, especially with small size and thick signatures.

The problem is further enhanced by the use of comparatively rigid signatures.

Thus, an operator's presence is required on a continued basis to prevent the signatures from being tilted rearwardly.

Moreover, conventional conveyors have the disadvantage that the signatures are picked up upon completion of the upward transport of the foremost signature, which is due to the substantial lack of impact between the signature following the foremost signature which is being picked up by the elevator belts.

This phenomenon is obviously specially evident in the case of particularly rigid signatures, or signatures of appreciable thickness. This phenomenon reflects, moreover, in a longer time for the formation of the stacks downstream of the elevator belts.

OBJECTS OF THE INVENTION

This invention sets out to provide an improved belt conveyor for signatures, loose sheets, gathered sheets, and the like, including a device for picking them up, which on one hand is capable of obviating the aforementioned drawbacks, and on the other hand, affords automatic operation of such conveyors even when the latter are operated at high operation speeds.

According to the invention, moreover, this improved conveyor, or the signature picking up device, can be produced in a simple manner and from a limited number of parts, the same being also adapted for incorporation in existing conveyor systems by performing a few simple adaptation operations.

SUMMARY OF THE INVENTION

According to one aspect of this invention, the improved conveyor comprises signature entraining means interposed between the feeder belts and elevator belts, means for sensing the presence of the signatures and controlling the actuation of the feeder belts being also preferably provided.

Advantageously, according to the invention, the elevator belts run is provided, on the input side thereof, with a deflecting roller effective to deflect the elevator belts from the oblique lay to a substantially vertical one.

Furthermore, in accordance with this invention, said means of entrainment of the signatures comprise rings located at the deflecting roller on the input end of the elevator belts, said rings being advantageously formed with an outer surface having a high frictional coefficient.

According to the invention, moreover, said rings are provided on that same deflecting roller on the input end of the elevator belts, the rings having a maximum thickness, or protruding areas or points, exceeding that of the elevator belts.

According to a first variation of the invention, the signature entraining means comprise a suction roller having at least two circumferential sectors formed with circumferentially distributed through holes, a tubular inner diaphragm of substantially C-like configuration, suction being applicable at the area where the horizontal feeder belts adjoins the sloping elevator belts.

According to a further variation of the invention, the signature entraining means comprise transverse strips set apart from one another on the outer side of the elevator belts. Obviously, said strips may be replaced with other projections of different geometries, e.g. cylindrical, pyramidal, polygonal, or otherwise.

More features and variations may be inferred from the appended subordinate claims.

BRIEF DESCRIPTION OF THE DRAWINGS

Further details, advantages and variations of this improved belt conveyor for signatures, loose sheets, gathered sheets and the like, and related pick up device, will become apparent from the following description of a preferred embodiment of the invention, as illustrated by way of example in the accompanying drawing, where.

DESCRIPTION OF THE PREFERRED EMBODIMENT

Figure 1:
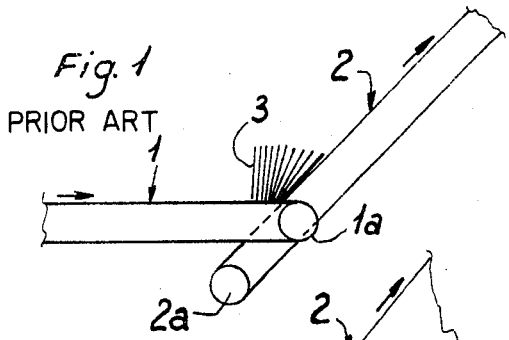
Fig. 1 PRIOR ART
FIG. 1 is a diagramatical side elevation fragmentary view of a conveyor at the transition area from the feeder belts to the elevator belts in a belt conveyor of conventional design.

Reference is made initially to FIG. 1, where a conveyor of traditional design is illustrated schematically. The conveyor feeder belts are indicated at 1, the same being provided in the form of individual belts in side-by-side relationship, the numeral 2 designating the elevator belts. At 1*a* and 2*a*, respectively, there are indicated path deflecting rollers for the belts 1 and 2, located at the area where the signatures 3 are moved upwards. As shown in FIG. 1, the upper runs of the belts 2 extend entirely in the same oblique plane, it forming with the belts 1 an obtuse angle the vertex whereof results from the line of intersection of the upper runs of the belts 1 and 2. Owing to the lower speed of the belts 1 with respect to the belts 2, this known equipment frequently produces, especially with rather "stiff" signatures, a situation whereby the signatures are urged at their lower edges in a direction such that the signatures open fan-like and the rearmost signatures tend to fall flat onto the belts 1. Although this phenomenon is related to the type, rigidity, thickness and size format of the signatures, it is always recognizable, albeit in varying extents, in all conventional conveyors of the type just described. The phenomenon is also due to the fact that, in known conveyors, the signatures are picked up in a spaced apart condition, and in operation, the engagement between the foremost signature and the elevator belts 2 hinders or in practice prevents the signature which follows the foremost one from contacting the belts 2 until the foremost signature has been practically completely removed. This, in turn, makes it impossible to develop high stacking rates, such rates being also related to the type of signatures being handled.

In the inventive arrangement, by contrast, the elevator belts 2 are deflected, prior to their entering the area of the belts 1 and through their deflecting roller 2*a*, to leave their oblique lay and extend downwards, in the example shown substantially vertically downwards, thereafter they are further deflected by additional rollers along the return run of the belts 2. Thus, at the crossing area between the upper reaches of the belts 1 and 2 there is formed a cleared angle $\alpha$ which allows the pack of signatures 3 to be brought closer to the elevator belts 2.

Furthermore, according to this invention, there are provided entrainment rings, two in number in the example shown, which are attached fixedly, e.g. by cementing them, to a specially provided roller which forms the cited deflecting roller 2*a* in the example shown. The rings 4 have a larger thickness dimension than the belts 2, that is to say that the outer surfaces of the rings 4 protrude outwardly from the outer sides of the belts 2, said outer surfaces being advantageously a roughened one. This protruding arrangement of the rings 4 results in the foremost of signatures 3 contacting said rings 4 immediately, thereby as soon as the foremost signature 3 has been moved upwards beyond the rings 4, the following signature abuts those same rings 4, so that the signatures 3 can now be rapidly moved upwards in overlapped relationship with one another. Positive abutment of the signature which follows the foremost signature against the rings 4 is ensured by the forward movement imparted by the belts 1 to the pack of signatures 3.

For simplicity reasons, the transport device overlying the elevator belts, has been omitted from the drawing, said device being any desired one.

The numeral 5 designates an interlocking or consent switch actuated by the presence of signatures, a contact reed whereof is indicated at 5*a*. The numeral 6 designates an additional switch, a contact reed whereof, 6*a*, lies in the path of the travel of the signatures 3 during their upward movement, said switches 5, 6 being operative, in the absence of signatures 3 moving past it, to operate the motor driving the belts 1 to produce a forward movement of, or rather apply a forward push to, the pack of signatures 3, thus ensuring positive engagement of the foremost signature, should the latter arrive in an excessively inclined attitude and fail to strike the contact reed 5*a* of the switch 5. By providing the circuit with the switches 5 and 6, which are preferably connected in series to each other, ensure a satisfactory operation of the conveyor.

According to a variation of this invention, the entraining rings 4 may be replaced with a plurality of through holes 7, which may be arranged for instance in two circumferential rows located at the same position as the rings 4, which holes are connected to suction means, known per se and not shown. An inner diaphragm 8 enables the suction or vacuum to be only applied at the signatures 3 pick up area of the belts 2. In the exemplary embodiment shown, the deflecting roller 2*a* for the belts 2 is still employed. Even when the suction arrangement is utilized, the conveyor operation is as described hereinabove and allows the signatures 3 to be moved upwards in a similarly overlapped relationship. The suction or vacuum generating unit, and its related control circuitry, are not illustrated herein, because they are known per se and well within the capabilties of an expert.

Figure 7:
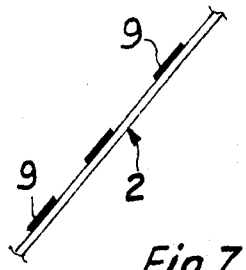
FIG. 7 illustrates schematically another variation of this invention.
Figure 2:
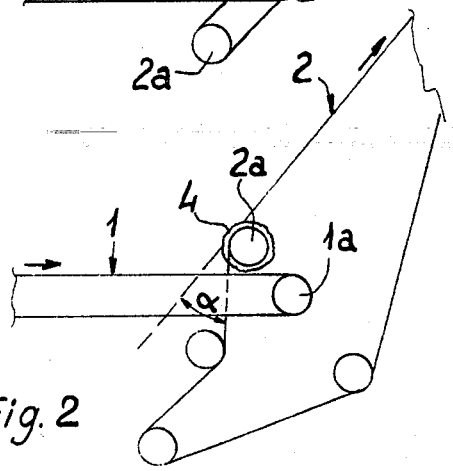
FIG. 2 shows diagramatically a side elevation sectional view, similar to FIG. 1, of a conveyor according to the invention.
Figure 6A:
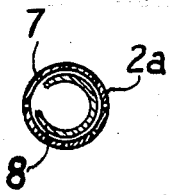
FIG. 6*a* is a schematical cross-sectional view taken along the line VI—VI of FIG. 6.
Figure 3:
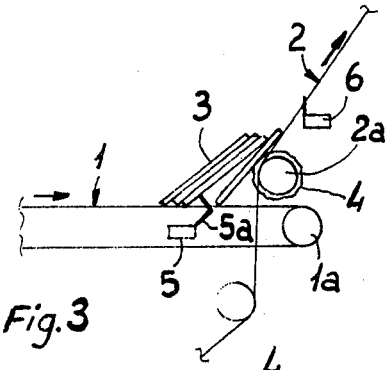
FIGS. 3 and 4 are views similar to FIG. 1, with signatures added, illustrating two successive transport steps of the signatures.
Figure 4:
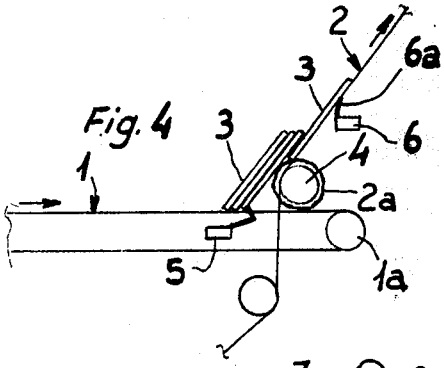

Furthermore, with the arrangement of the belts 2 according to this invention, it is also possible to utilize belts 2 provided with outer pick up lugs 9 on the outer surfaces of the belts 2 spaced apart from one another, said lugs projections being for example in the form of projecting strips, laid side-by-side similarly to studs, etc., as shown in projections FIG. 7.

Figure 5:
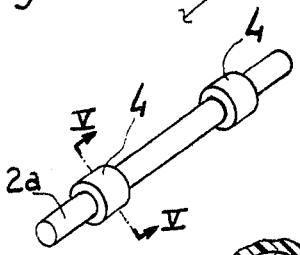
FIG. 5 is a perspective view of a roller provided with entrainment rings according to this invention.
Figure 6:
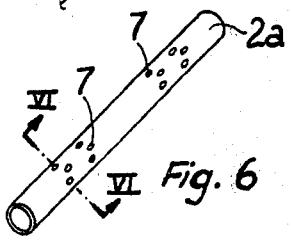
FIG. 6 shows schematically and in perspective a variation of the roller provided with signature entraining means, according to the invention.
Figure 5A:
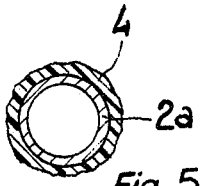
FIG. 5*a* is an enlarged scale schematical section taken along the line V—V of FIG. 5.

In practicing the invention, the rings 4 may be formed from any suitable material, e.g. rubber, and their outer surfaces may be roughened to any desired pattern; alternatively, annular or ring-like ridges may be provided integrally with the belt deflecting roller (see FIG. 5), whereto a high frictional coefficient coating is then applied, depending on individual applicational requirements.

It will also be possible to replace any individual parts with other technically and functionwise elements: for example, the substantially vertical run of the belts 2*a* at the belts 1 may be caused to extend along a sloping direction, or a supporting cylinder may be provided for the rings 4 other than the deflecting roller 2*a*, mounted in the proximity of the latter, or even form the supporting cylinder for the rings 4, for example, from a synthetic material; as a further alternative, one switch 5 may be provided, or a higher number of rings 4 may be provided, or a cylinder pre-assembled with the rings 4 may be introduced in a conventional type of conveyor proximate to the crossing point of the feeder belts with the elevator belts, and so forth, without departing from the purview of this invention.

It will be appreciated from the foregoing that the solution proposed effectively achieves the objects and advantages mentioned in the preamble, and in particular that of a positive engagement with the signatures to be picked up, a high speed of upward transport of the same in overlapping relationship, very simple construction, applicability to existing conveyors, as well as a reliable operation, as ensured by the provision of an interlock switch sensing the presence of paper in the same plane as the feeder belts, and preferably of a further interlock switch downstream of said entraining rings or the like. Such advantages are also to be secured by the embodiment providing a pneumatic type of pick up, although the latter will involve the provision of additional equipment.

Advantageously, the protruding thickness of the entraining rings is selected to relate to the thickness of the thickest signatures being handled.

The dimensions and materials may be selected as desired without departing from the purview of the instant inventive concept.

All of the features which can be inferred from the foregoing description, from the drawing and appended claims, are substantial to the invention, either individually or in any desired combination thereof.

We claim:

1. An improved belt conveyor for signatures, loose sheets, gathered sheets, and the like, having a device for picking up said signatures, etc., and being of the type including a set of feeder belts lying in a substantially horizontal plane and an associated set of elevator belts that receive signatures, etc., delivered to them by the feeder belts, said elevator belts lying in a substantially oblique plane which intersects the horizontal plane of the feeder belts, said feeder belts transporting signatures, etc., toward the intersection between said feeder and elevator belts, and said planes defining a first obtuse solid angular space, characterized in that:

(A) said set of elevator belts having at the output ends thereof near the set of feeder belts a deflecting roller the axis of rotation of which is parallel to the apex of the solid angle between said sets of belts, said deflecting roller being located in the path of travel of signatures, etc., leaving the feeder belts, and directing the elevator belts to pass through said feeder belts in a steeper plane than the oblique plane of said elevator belts leaving the deflecting roller, whereby there is provided at the intersection between said sets of belts a second angular space which is larger than the first angular space, (B) said deflecting roller being provided with signature, etc., entrainment rings in the path of travel of signatures, etc., leaving the feeder belts, (C) said rings having outer surfaces with a high frictional coefficient, which rings at least in part protrude beyond the elevator belts, whereby to contact and lift the foremost signature, etc., entering the second angular space as soon as the preceding signature, etc., has cleared said angular space.

2. An improved belt conveyor according to claim 1, wherein the entrainment rings are integral with the deflecting roller.

3. An improved belt conveyor according to claim 1, wherein the entrainment rings constitute coatings of a high frictional coefficient such as rubber with a roughened external surface.

4. An improved belt conveyor according to claim 1, wherein said signature entrainment rings are provided on a separate roller located in the proximity of said deflecting roller on the input side of said elevator belts.

5. An improved belt conveyor according to claim 1, wherein said rings are at least two in number and torque-wise rigidly attached to the associated supporting roller between any two adjacent elevator belts.

6. An improved belt conveyor according to claim 1, wherein said means for sensing the presence of the signatures comprise a first electric switch, or the like, the movable portion whereof is located proximate to the second angular space from said horizontal feeder belts to said oblique elevator belts.

7. An improved belt conveyor according to claim 6, wherein said means for sensing the presence of the signatures further comprise a second electric switch, or the like, located downstream of the input side of said elevator belts, said switch being in series with said first electric switch.

* * * * *